US007362346B2

(12) United States Patent
Watanabe et al.

(10) Patent No.: US 7,362,346 B2
(45) Date of Patent: Apr. 22, 2008

(54) PRINTER APPARATUS

(75) Inventors: Sumio Watanabe, Shinagawa (JP); Fumio Sakurai, Shinagawa (JP); Yukihiro Mori, Shinagawa (JP); Masahiro Tsuchiya, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 225 days.

(21) Appl. No.: 11/299,627

(22) Filed: Dec. 13, 2005

(65) Prior Publication Data

US 2006/0221171 A1 Oct. 5, 2006

(30) Foreign Application Priority Data

Mar. 30, 2005 (JP) ..... 2005-099873

(51) Int. Cl.
*B41J 29/00* (2006.01)

(52) U.S. Cl. ..... 347/222

(58) Field of Classification Search ..... 347/222; 400/613

See application file for complete search history.

(56) References Cited

U.S. PATENT DOCUMENTS 5,255,989 A * 10/1993 Berthold et al. ..... 400/605
5,782,567 A * 7/1998 Endo ..... 400/621
2003/0156881 A1 8/2003 Iwata
2004/0265030 A1 12/2004 Uehara
2005/0002715 A1 1/2005 Fries et al.
2005/0036820 A1* 2/2005 Watanabe et al. ..... 400/621

FOREIGN PATENT DOCUMENTS

EP 0 798 122 A2 10/1997
JP 10-101252 4/1998
JP 11-185064 7/1999

OTHER PUBLICATIONS

Search Report mailed on Aug. 30, 2006 in a corresponding European Patent application.

* cited by examiner

*Primary Examiner*—Huan H Tran
(74) *Attorney, Agent, or Firm*—Staas & Halsey LLP

(57) ABSTRACT

A printer apparatus is disclosed that includes a printer unit, a first chassis, and a second chassis that is arranged to open/close through rotation. The printer unit includes a thermal head, a first module having a motor, and a second module having a platen roller and a rotating body. The first chassis includes a heat sensitive paper roll accommodating portion and a mount portion to which the first module is mounted. The second chassis includes mount portions to which the second module and a printed paper roll shaft are mounted, a printed paper roll accommodating portion, and a rotation transmitting mechanism. When the second chassis is closed, the heat sensitive paper roll accommodating portion is closed, the second module is coupled to the first module, the rotating body is rotated by the motor, and the shaft is rotated by the motor via the rotating body and the rotation transmitting mechanism.

8 Claims, 14 Drawing Sheets

PRINTER APPARATUS

BACKGROUND OF THE INVENTION

1. Field of the Invention

The present invention relates to a journal thermal printer apparatus.

2. Description of the Related Art

A thermal printer that uses a heat sensitive paper roll has a printer unit including a thermal head and a platen roller.

Such a thermal printer may be applied to a receipt printer that is configured to cut and output printed paper to be handed to a customer, or a journal printer that is configured to roll up the printed paper.

It is noted that the receipt printer is generally arranged to have a clam shell type printer configuration in order to facilitate setting of a heat sensitive paper roll. The clam shell type printer includes a roll accommodating portion, a cover that may be opened/closed through rotation to cover/uncover the roll accommodating portion, and a platen roller that is arranged at the edge of the cover. When the cover is closed, the platen roller holds the heat sensitive paper between the platen roller and the thermal head, and when the cover is raised and opened, the upper side of the roll accommodating portion is uncovered so that a heat sensitive paper roll may be easily set therein.

It is noted that the receipt printer may be embodied as a portable thermal printer that is configured to be carried by an operator. Accordingly, techniques are being developed for realizing miniaturization of the receipt type thermal printer.

The journal printer uses a heat sensitive roll that is large in diameter. It is noted that generally, a smaller number of lines are printed in one print job performed at the journal printer compared to that performed at the receipt printer. For example, in a POS (Point of Sale) terminal used at a retail store, information on each item of purchase made by a customer is printed at the receipt printer, whereas at the journal printer, the total price of the items purchased by a customer is printed so that only one line is used for each customer. Since the heat sensitive paper roll is less frequently exchanged and for other reasons, the journal printer is generally not arranged into the clam shell type printer configuration. Accordingly, in order to exchange the heat sensitive paper roll in the journal printer, a cover arranged at a side of the POS terminal has to be removed, and the heat sensitive paper roll has to be exchanged from the side of the POS terminal.

The journal printer has conventionally been used as a stationary printer, and thereby, the configuration described above has been adequate for serving its purpose.

However, from now on, with the growing diversification of services, application of the journal type thermal printer as a portable thermal printer may be in demand.

Thus, a technique is required for arranging the journal thermal printer into the clam shell type configuration, and miniaturizing the journal thermal printer.

It is noted that in the journal printer, an operation of rolling up printed paper has to be stably performed. Also, upon configuring the journal printer into a portable printer, measures need to be implemented to prevent malfunction of the journal printer from occurring regardless of the position in which the journal printer is held.

Japanese Laid-Open Patent Publication No. 11-185064 discloses a journal thermal printer that includes a top cover that may be opened/closed, and a platen roller that is attached to the top cover.

However, in the disclosed journal printer, the operation of rolling up printed paper is realized using friction generated at the heat sensitive roll when the heat sensitive paper is pulled, and in such an arrangement, the operation of rolling up the printed paper cannot be stably performed. Also, the printed side of the printed paper may rub against the heat sensitive paper being pulled out from the heat sensitive paper roll so that the heat sensitive paper pulled out from the heat sensitive paper roll may be unnecessarily tainted.

SUMMARY OF THE INVENTION

The present invention has been conceived in response to one or more of the problems described above.

According to one aspect of the present invention, a printer apparatus is provided that includes:

a printer unit including a thermal head, a platen roller, and a motor;

a heat sensitive paper roll accommodating portion that accommodates a heat sensitive paper roll;

a printed paper roll shaft that rolls up printed paper that is drawn from the heat sensitive paper roll and is carried through the printer unit;

a rotating open/close member that is arranged to be opened/closed through rotation; and a rotation transmitting mechanism that transmits the rotation of the motor of the printer unit to the printed paper roll shaft;

wherein when the rotating open/close member is closed, the rotating open/close member covers the heat sensitive paper roll accommodating portion, the platen roller comes into contact with the thermal head and is rotated by the motor, and the printed paper roll shaft is rotated by the motor via the rotation transmitting mechanism.

According to another embodiment of the present invention, a printer apparatus is provided that includes:

a printer unit that includes a thermal head, a first module including a motor, and a second module including a platen roller and a rotating body;

a printed paper roll shaft that rolls up printed paper that is drawn from a heat sensitive paper roll and is carried through the printer unit;

a first chassis that includes a heat sensitive paper roll accommodating portion that accommodates the heat sensitive paper roll, and a first mount portion to which the first module is mounted;

a second chassis that is configured to rotate with respect to the first chassis to be opened/closed, the second chassis including a second mount portion to which the second module is mounted, a rotation transmitting mechanism that transmits the rotation of the rotating body to the printed paper roll shaft, and a printed paper roll accommodating portion that accommodates a printed paper roll that is created by rolling the printed paper around the printed paper roll shaft;

wherein when the second chassis is closed, the heat sensitive paper roll accommodating portion is closed, the second module is coupled to the first module, the platen roller is rotated by the motor, the rotating body is rotated by the motor, and the printed paper roll shaft is rotated by the motor via the rotating body and the rotation transmitting mechanism.

According to another embodiment of the present invention, a printer apparatus is provided that includes:

a printer unit that includes a thermal head, a first module including a motor, and a second module including a platen roller and a rotating body;

a chassis including a heat sensitive paper roll accommodating portion that accommodates a heat sensitive paper roll, a printed paper roll shaft that rolls up printed paper that is drawn from the heat sensitive paper roll and is carried through the printer unit, a printed paper roll accommodating portion that accommodates a printed paper roll that is created by rolling the printed paper around the printed paper roll shaft, and a first mount portion to which the first module is mounted;

a rotating lid member that is configured to rotate with respect to the chassis to be opened/closed, the rotating lid member including a second mount portion to which the second module is mounted; and a rotation transmitting mechanism that transmits the rotation of the rotating body to the printed paper roll shaft;

wherein when the rotating lid member is closed, the heat sensitive paper roll accommodating portion is closed, the second module is coupled to the first module, the platen roller is rotated by the motor, the rotating body is rotated by the motor, and the printed paper roll shaft is rotated by the motor via the rotating body and the rotation transmitting mechanism.

According to another embodiment of the present invention, a printer apparatus is provided that includes:

a printer unit that includes a thermal head, a first module including a motor, and a second module including a platen roller and a rotating body;

a printed paper roll shaft that rolls up printed paper that is drawn from a heat sensitive paper roll and is carried through the printer unit;

a first chassis that includes a heat sensitive paper roll accommodating portion that accommodates the heat sensitive paper roll, and a first mount portion to which the first module is mounted;

a second chassis that is configured to be attached to and detached from the first chassis, the second chassis including a second mount portion to which the second module is mounted, a shaft mount portion to which the printed paper shaft is mounted, a rotation transmitting mechanism that transmits a rotation of the rotating body to the printed paper roll shaft, a heat sensitive paper roll supporting portion that is arranged at a lower surface side of the second chassis and is configured to support the heat sensitive paper roll, and a printed paper roll accommodating portion that is arranged at an upper surface side of the second chassis and is configured to accommodate a printed paper roll that is created by rolling the printed paper around the printed paper roll shaft;

wherein heat sensitive paper that is drawn from the heat sensitive paper roll is arranged to pass a portion of the second module and the upper surface side of the second chassis, and an edge portion of the heat sensitive paper is arranged to be wound around the printed paper roll shaft; and when the second chassis is attached to the first chassis, the second module is coupled to the first module, the platen roller is rotated by the motor, the rotating body is rotated by the motor, and the printed paper roll shaft is rotated by the motor via the rotating body and the rotation transmitting mechanism.

DESCRIPTION OF THE PREFERRED EMBODIMENTS

In the following, preferred embodiments of the present invention are described with reference to the accompanying drawings.

Embodiment 1

Figure 1A:
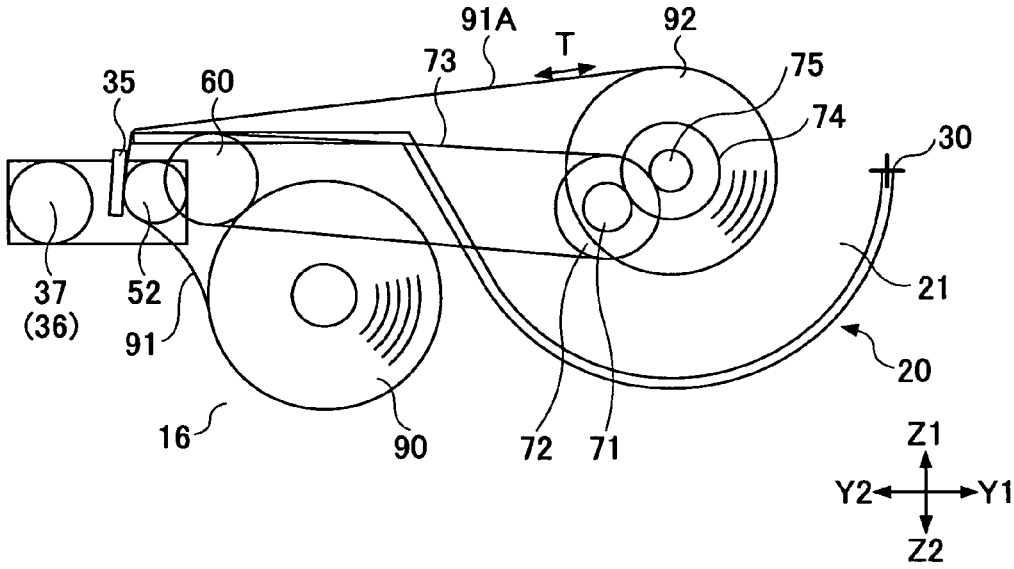
FIGS. 1A and 1B are diagrams showing a basic configuration of a journal thermal printer apparatus according to a first embodiment of the present invention.
Figure 1B:
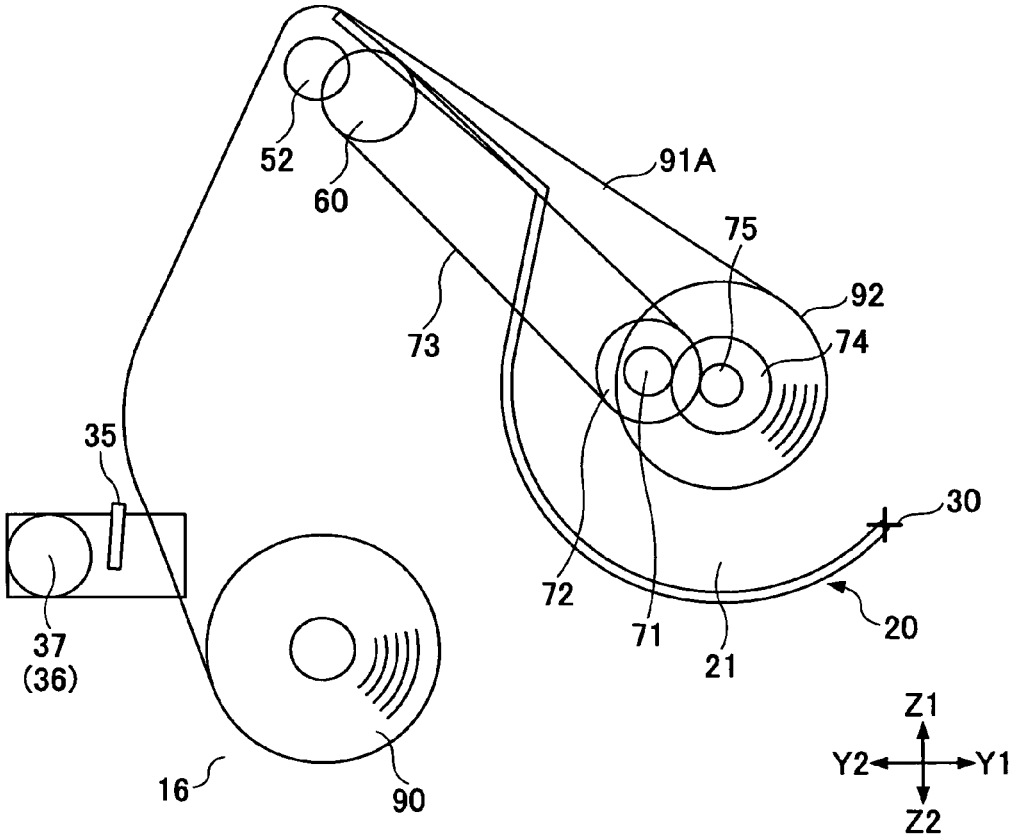
Figure 2:
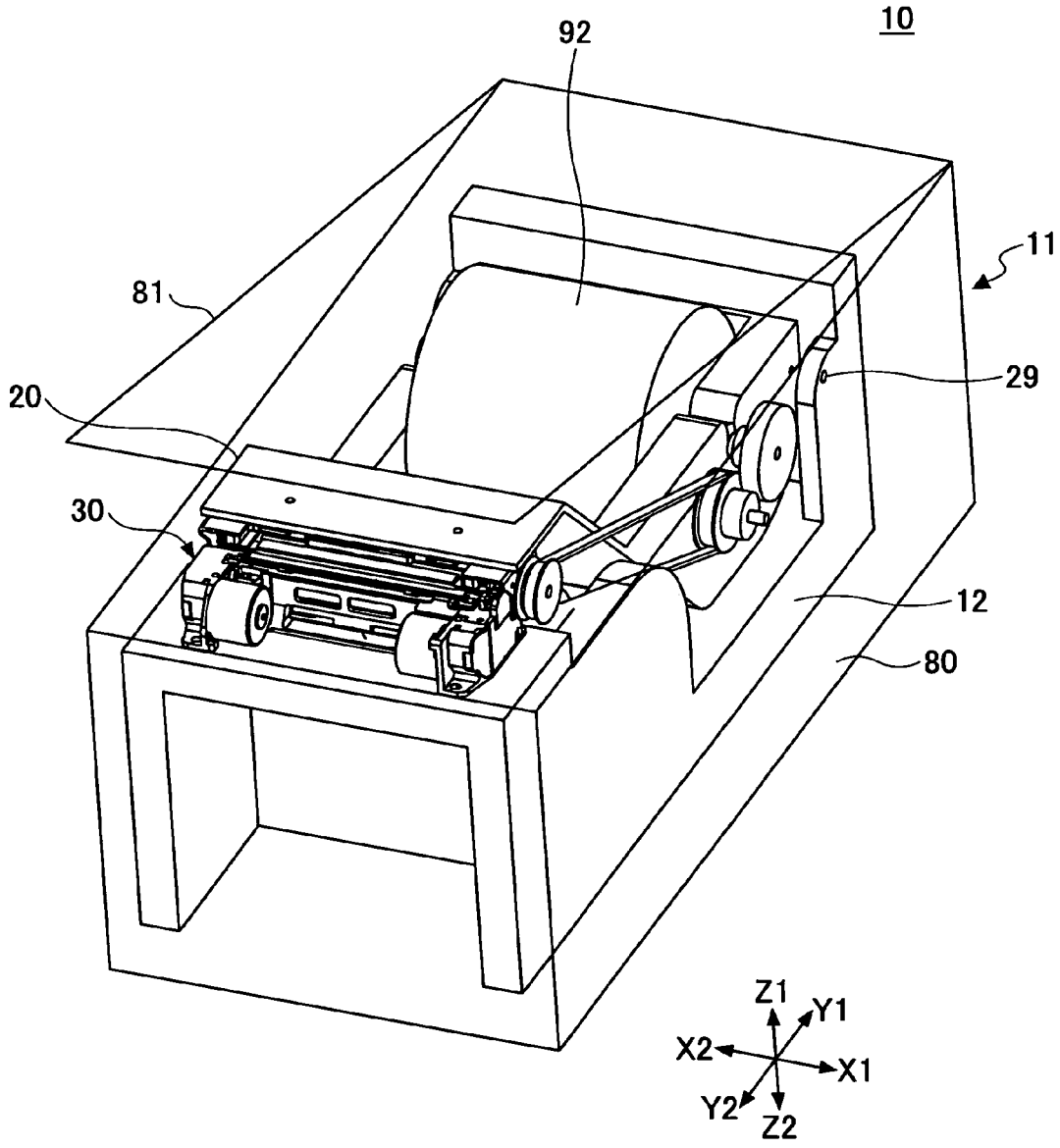
FIG. 2 is a perspective view of the journal thermal printer apparatus of the first embodiment.
Figure 3:
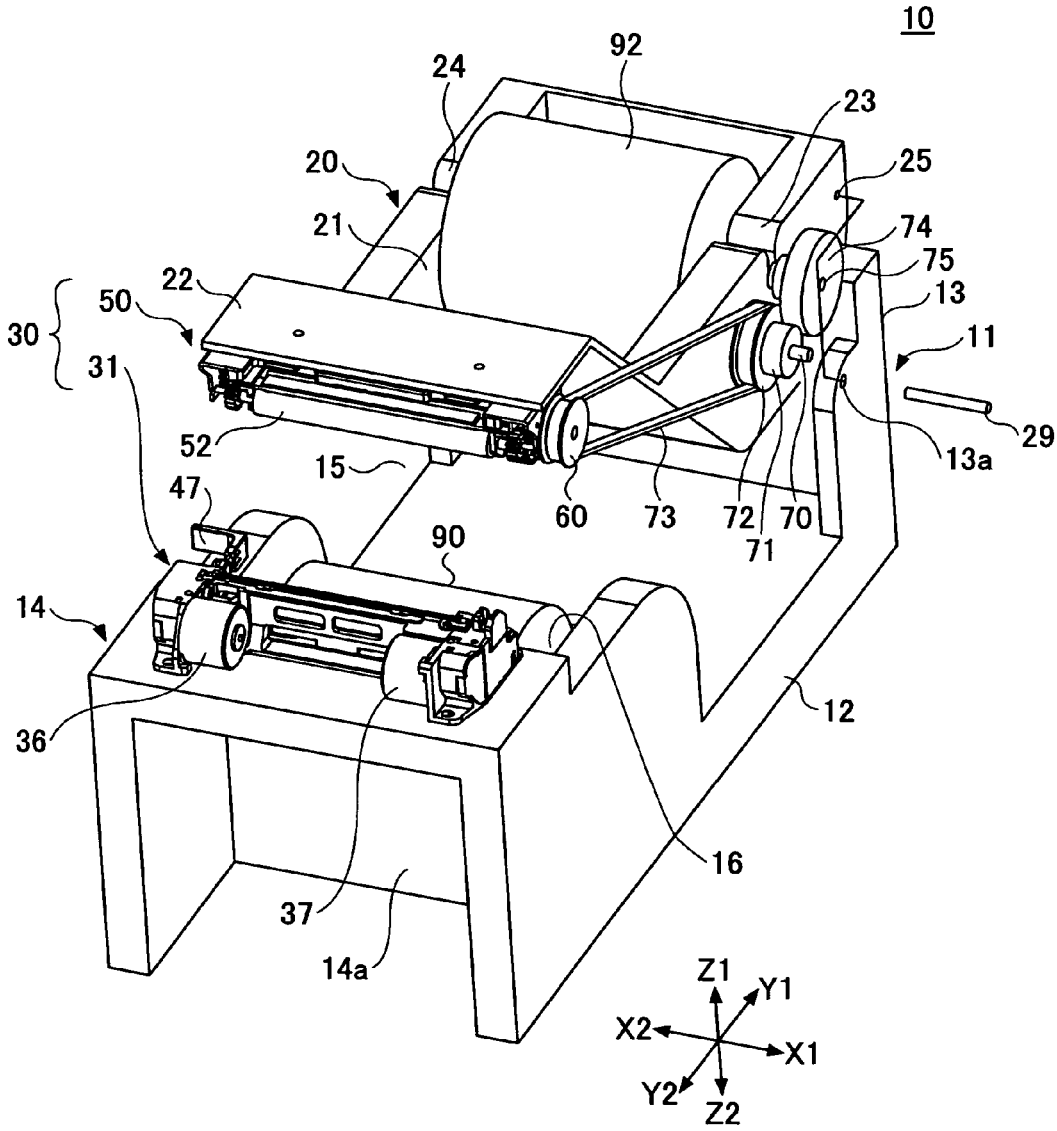
FIG. 3 is an exploded perspective view of the journal thermal printer apparatus of the first embodiment.

FIGS. 1A and 1B are diagrams illustrating a basic configuration of a journal thermal printer apparatus 10 (simply referred to as 'printer apparatus 10' hereinafter) according to a first embodiment of the present invention. FIG. 2 is a perspective view of the printer apparatus 10. FIG. 3 is an exploded perspective view of the printer apparatus 10. It is noted that in the drawings, directions X1-X2 represent width directions of the printer apparatus 10, directions Y1-Y2 represent length directions of the printer apparatus 10, and directions Z1-Z2 represent height directions of the printer apparatus 10.

The printer apparatus 10 is arranged into a clam shell type printer configuration, and includes a first chassis 11, a second chassis 20, and a printer unit 30 that are accommodated within a case 80 having a top lid 81 as is shown in FIG. 2. The top lid 81 covers the second chassis 20 in a closed state, and by raising the Y2 side of the top lid 81, this top lid 81 may be rotated with respect to its Y1 side edge to be opened.

As is shown in FIG. 3, the first chassis 11 is arranged into a box-like structure having a bottom plate portion 12, a Y1 side wall portion 13, and a Y2 side wall portion 14. A space 15 is provided between the wall portion 13 and the wall portion 14, and the second chassis 20 may be accommodated within this space 15. The wall portion 13 is arranged into a U-shaped structure viewed from the Z1 side, and is configured to rotatably support the second chassis 20. The wall portion 14 is arranged into a substantially H-shaped structure viewed from the Z1 side, and includes a wall plate 14*a* that extends in the X1-X2 directions and a heat sensitive paper roll accommodating portion 16 arranged at the Y1 side of the wall plate 14*a* for accommodating a heat sensitive paper roll 90.

As is shown in FIG. 3, the second chassis 20 is arranged into a boat-like structure, and includes an accommodating portion 21 that accommodates a journal paper roll 92 corresponding to printed heat sensitive paper as journal paper that is rolled up, and an extending plate portion 22 that extends substantially in the Y2 direction from the journal paper roll accommodating portion 21.

Also, a shaft pin 29 is inserted into a hole 13*a* of the wall portion 13 and a hole 25 of a wall of the second chassis 20. The second chassis 20 is configured to rotate around the shaft pin 29 to move between a 'closed position' (FIG. 1A and FIG. 2) and an 'open position' (FIG. 1B). When the second chassis is arranged at the 'closed position', the journal paper roll accommodating portion 21 is accommodated within the space 15, and the extending plate portion 22 covers the upper side of the heat sensitive paper roll accommodating portion 16.

Figure 4:
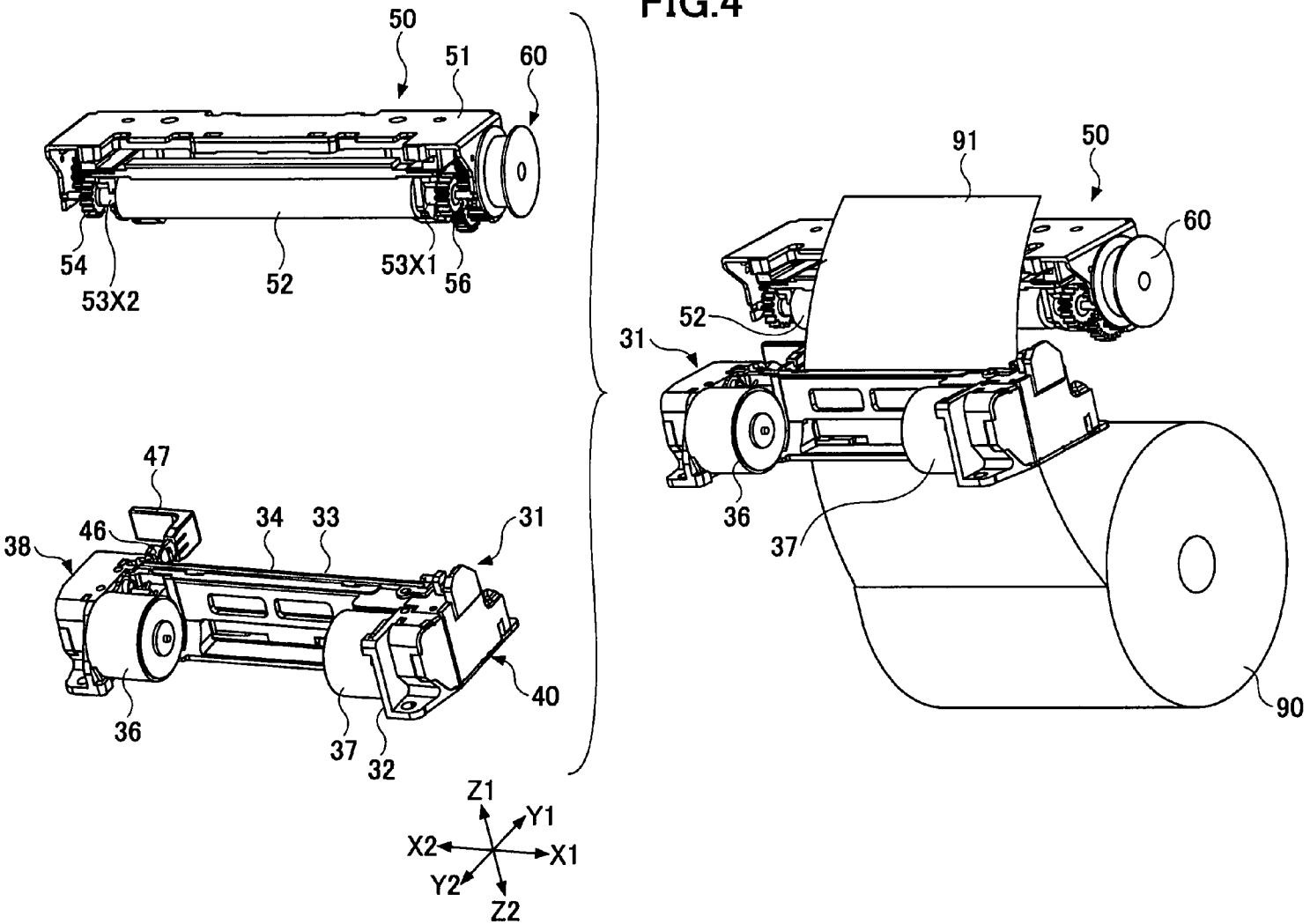
FIG. 4 is a perspective view of a printer unit of the journal thermal printer apparatus of the first embodiment.
Figure 5A:
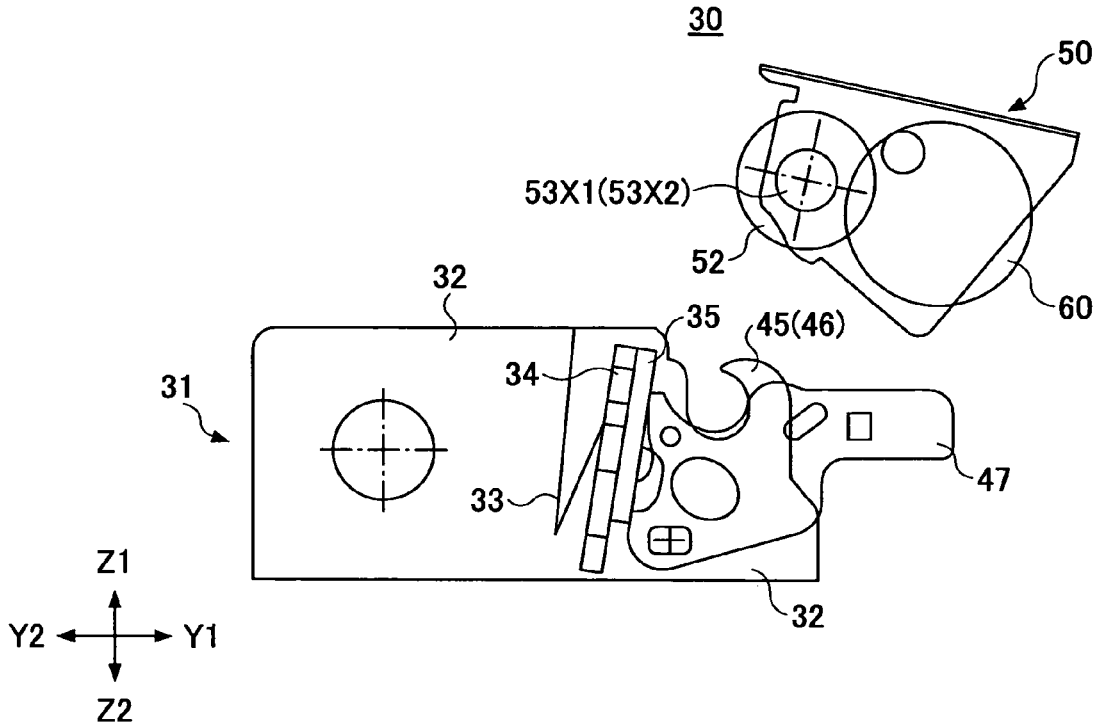
FIGS. 5A and 5B are diagrams showing the printer unit of FIG. 4 in a separated state and a coupled state, respectively.
Figure 5B:
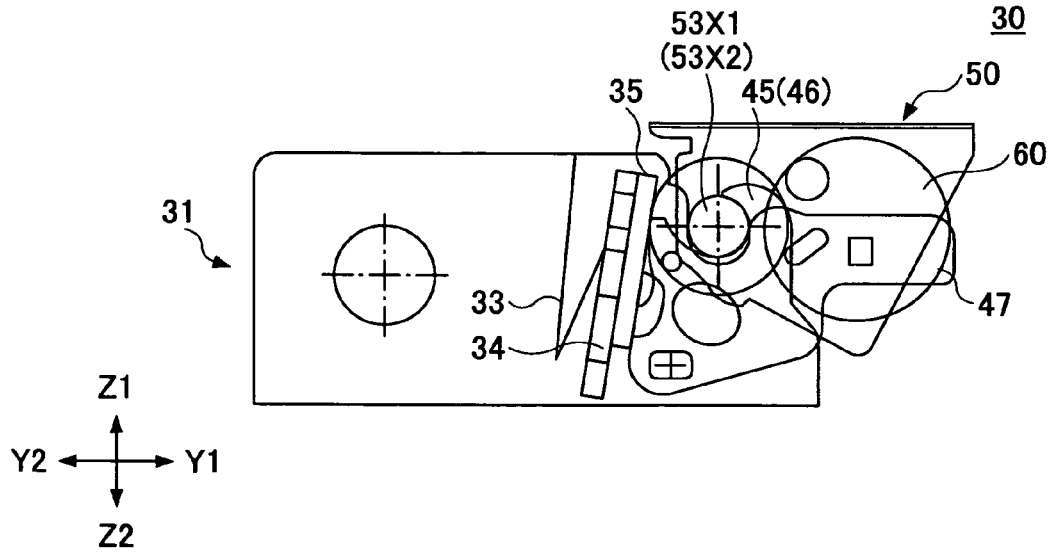

FIG. 4 is a perspective view of the printer unit 30 shown in FIG. 3, and FIGS. 5A and 5B are side views illustrating the printer unit 30 in a separated state and an attached state, respectively. As is shown in these drawings, the printer unit 30 includes a first module 31 and a second module 50 that may be detached from or attached to each other.

Figure 6:
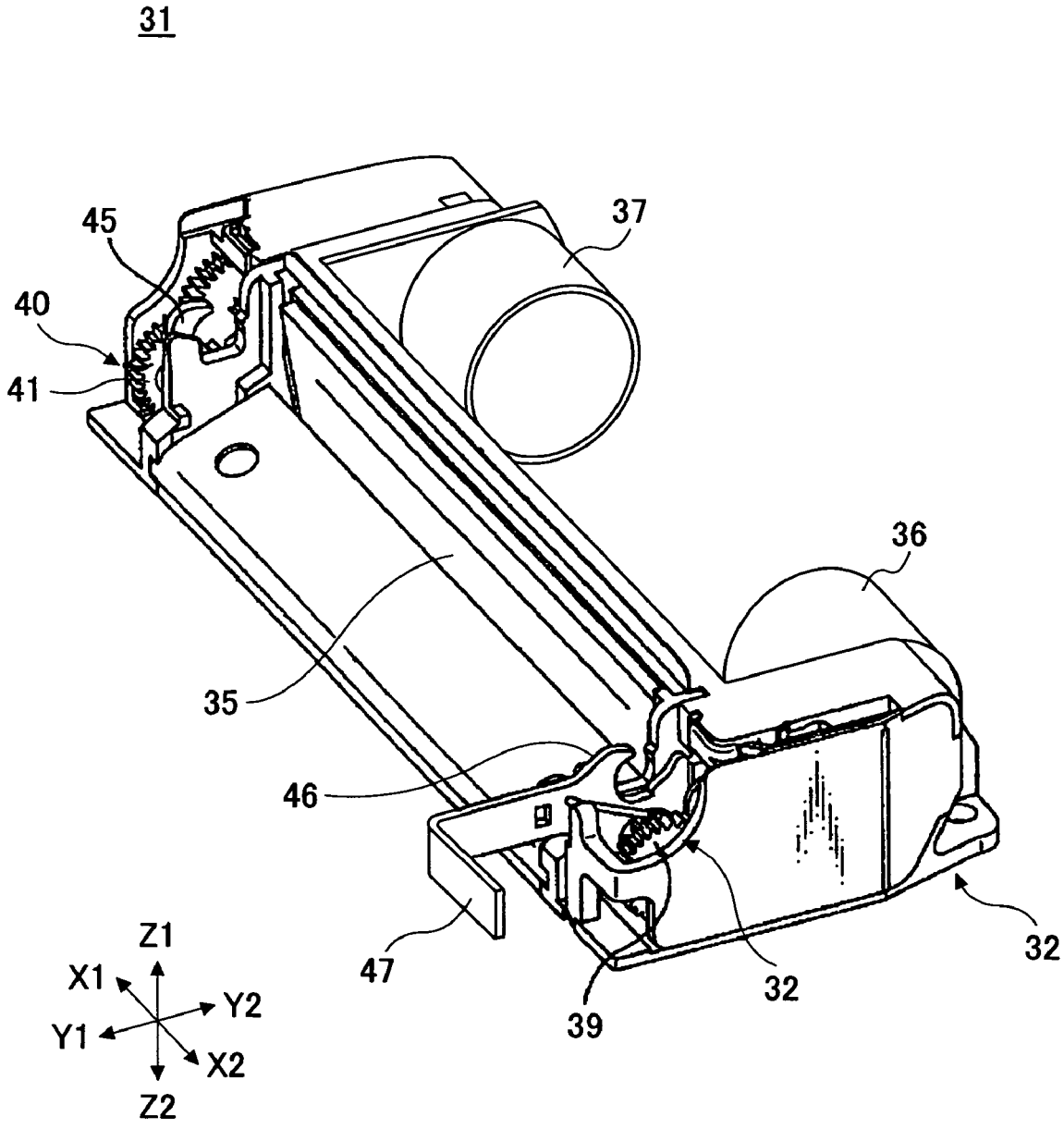
FIG. 6 is a diagram showing a first module of the printer unit of FIG. 4.
Figure 7:
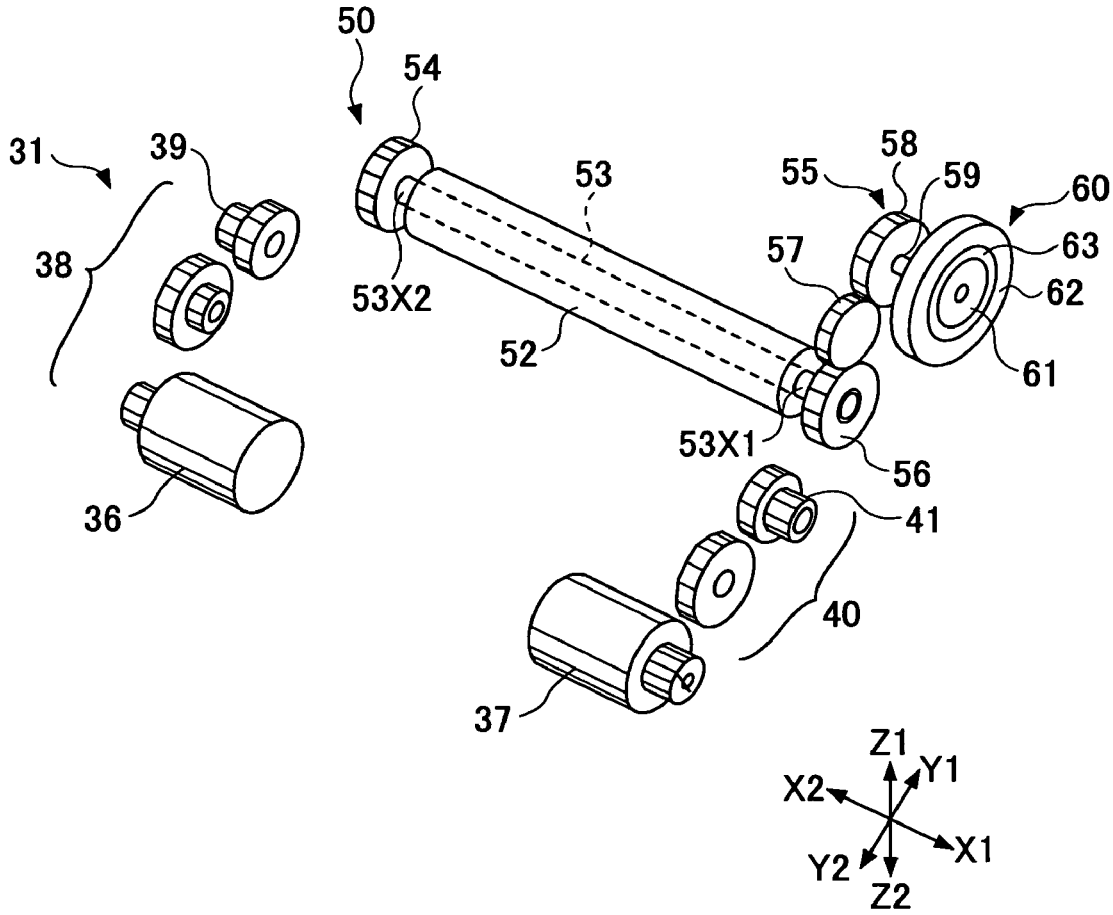
FIG. 7 is a diagram showing components of the printer unit of FIG. 4.

FIG. 5A illustrates a state in which the second module 50 is detached from the first module 31, and FIG. 5B illustrates a state in which the second module 50 is attached to the first module 31. FIG. 6 is a perspective view of the first module 31 viewed from the reverse side (in the X1-X2 directions) with respect to the perspective view shown in FIG. 4. FIG. 7 is a diagram illustrating a first gear row, a motor, a second gear row, a platen roller, and a pulley of the first module 31 and the second module 50 shown in FIG. 4.

As is shown in FIGS. 4 through 7, the first module 31 includes a frame 32; a head pressure applying plate spring member 33, a thermal head supporting member 34, and a thermal head 35 that are arranged at the Y1 side of the frame 32; a paper transporting pulse motor 36 and a journal paper rolling pulse motor 37 that are arranged at the Y2 side of the frame 32; a first gear row 38 arranged at the X2 side of the frame 32; a second gear row 40 arranged at the X1 side of the frame 32; and lock members 45, 46, and an operations lever 47 that are attached to the frame 32.

The first gear row 38 is configured to transmit the rotation of the sheet transporting pulse motor 36, and includes an output gear 39. The second gear row 40 is configured to transmit the rotation of the journal paper rolling pulse motor 37, and includes an output gear 41. The lock members 45 and 46 are arranged at the X1 side and the X2 side of the first module 31, respectively, and are arranged to co-operate. In FIG. 5A, a force from a spring (not shown) is applied to the lock members 45 and 46 in the counterclockwise direction. The operations lever 47 is arranged to extend from the lock member 46.

As is shown in FIGS. 4, 5A, and 7, the second module 50 includes a frame 51; and a platen roller 52, a gear row 55, and a pulley 60 that are attached to the frame 51.

The platen roller 52 is rotatably supported at the frame 51 by a center shaft 53 having center shaft portions 53X1 and 53X2 that are engaged with the frame 51. The center shaft portion 53X2 has a gear 54 attached thereto.

The gear row 55 includes gears 56, 57, and 58 that are arranged at the X1 side of the frame 51. The gear 56 is rotatably supported by the center shaft portion 53X1. The pulley 60 corresponds to a rotating body of the second module 50 in the present embodiment, and includes an inner rotating body 61, an outer pulley main body 62, and a torque limiter portion 63 that is arranged between the inner rotating body 61 and the outer pulley main body 62. The inner rotating body 61 is arranged at the outer side of the frame 51, and is fixed to a shaft 59, which is arranged as an integral part of the gear 58. The shaft 59 is rotatably supported at the frame 51.

Referring back to FIG. 3, the first module 31 is attached to the wall portion 14 of the first chassis 11. The second module 50 is attached to the lower surface of an edge of the extending plate portion 22 of the second chassis 20.

As is shown in FIGS. 1 and 3, the second chassis 20 includes a shaft 70 that is arranged at a side plate at the X1 side of the Y1 side wall portion 13, and a pulley 72 having a gear 71 integrally formed therewith that is rotatably supported by the shaft 70. A timing belt 73 is arranged around the pulley 60 and the pulley 72 to realize a rotation transmitting mechanism of the second chassis 20 in the present embodiment.

U-shaped grooves 23 and 24 are arranged at X1 and X2 side plates of the journal paper roll accommodating portion 21 of the second chassis 20. A journal paper roll shaft 75 having a gear 74 fixed to its X1 side end is engaged with and supported by the U-shaped grooves 23 and 24. The journal paper roll shaft 75 is arranged to extend in the X1-X2 directions across the journal paper roll accommodating portion 21, and the gear 74 is arranged to be engaged with the gear 71. The journal paper roll shaft 75 may be raised in the Z1 direction to be detached from the second chassis 20.

In the following, operations of the journal thermal printer 10 are described.

(1) Preparation for Starting Print Operation

The top lid 81 is opened to arrange the second chassis 20 into the 'open position', and the heat sensitive paper roll 90 is placed inside the heat sensitive paper roll accommodating portion 16 as is shown in FIG. 1B. Then, as is shown in FIG. 4, the heat sensitive paper 91 is drawn from the heat sensitive paper roll 90, and the heat sensitive paper 91 is arranged to extend across the front side of the second module 50 and the upper surface side of the extending plate portion 22 of the second chassis 20 so that its edge portion may be rolled onto the journal paper roll shaft 75. The journal paper roll shaft 75 is engaged with the U-shaped grooves 23 and 24. In this way, the gear 74 may be engaged with the gear 71. Then, the second chassis 20 is rotated to be arranged into the 'closed position' as is shown in FIG. 1A, and the center shaft portions 53X1 and 53X2 arranged at the X1 and X2 sides of the platen roller 52 are engaged with the lock members 45 and 46, respectively.

In this way, the heat sensitive paper 91 may be held between the platen roller 52 and the thermal head 35. Also, the gear 54 engages with the output gear 39, and the gear 56 engages with the output gear 41. Then, the top lid 81 is closed so that a print operation may be started.

(2) Print Operation

The thermal head 35 is driven by a print command, and the paper transporting pulse motor 36 and the journal paper rolling pulse motor 37 are driven at a predetermined timing.

By driving the thermal head 35, printing may be performed on the heat sensitive paper 91.

By driving the paper transporting pulse motor 36, the platen roller 52 may be rotated via the first gear row 38 and the gear 54, and the printed heat sensitive paper 91A may be transported.

By driving the journal rolling pulse motor 37, the journal paper roll shaft 75 may be rotated in the clockwise direction via the second gear row 40, the gear row 55, the pulley 60, the timing belt 73, the pulley 72, the gear 71, and the gear 74 so that the printed heat sensitive paper 91A may be wound around the periphery of the journal paper roll shaft 75. In this way, the printed heat sensitive paper (journal paper) roll 92 is gradually formed within the journal paper roll accommodating portion 21.

By the action of the torque limiter portion 63 of the pulley 60, the portion of the heat sensitive paper 91 extending from the platen roller 52 across the upper surface side of the second chassis 20 to the journal paper roll shaft 75 is stretched with tension T so that the printed heat sensitive paper 91A may be tightly wound to form the printed heat sensitive paper roll 92.

In the case of incorporating the journal thermal printer apparatus 10 as is described above in a portable apparatus, the position of the journal thermal printer 10 may be unstable. However, in the present embodiment, the transmission of rotation from the journal paper rolling pulse motor 37 to the journal paper roll shaft 75 is realized by the timing belt 73, for example, so that stability of the transmission of rotation may be maintained and the heat sensitive paper 91A may be stably rolled even when the position of the journal thermal printer 10 is changed.

Also, in the present embodiment, the journal paper rolling pulse motor 37, which is dedicated to the formation of the printed heat sensitive paper roll 92, is provided so that adequate torque may be transmitted to the journal paper roll shaft 75 and the printed heat sensitive paper roll 92 may be stably formed even when its diameter is increased.

(3) Heat Sensitive Paper Roll Exchange Operation

When the heat sensitive paper 91 of the heat sensitive paper roll 90 is used up, the operator may open the top lid 81 to pull out and remove the printed heat sensitive paper roll 92 along with the journal paper roll shaft 75, and then remove the printed heat sensitive paper roll 92 from the journal paper roll shaft 75 to store the printed heat sensitive paper roll 92.

Then, the operator may operate the operations lever 47 to release the center shaft portions 53X1 and 53X2 at the sides of the platen roller 52 from the lock realized by the lock members 45 and 46, and rotate the second chassis 20 to the 'open position' as is shown in FIG. 1B. Then, a new heat sensitive paper roll 90 may be placed inside the heat sensitive paper roll accommodating portion 16.

Then, operations identical to the preparatory operations for starting a print operation are performed. That is, as is shown in FIG. 4, the heat sensitive paper 91 is drawn from the heat sensitive paper roll 90, and the heat sensitive paper 91 is arranged to extend across the front side of the second module 50 and the upper surface side of the extending plate portion 22 of the second chassis 20 so that its edge portion may be rolled onto the journal paper roll shaft 75, which is engaged with the U-shaped grooves 23 and 24. Then, the second chassis 20 is rotated to the 'closed position' as is shown in FIG. 1A, and the center shaft portions 53X1 and 53X2 at the X1 and X2 sides of the platen roller 52 are locked to the lock members 45 and 46, respectively. Then, the top lid 81 is closed.

In this way, the heat sensitive paper roll may be exchanged through simple procedures.

Embodiment 2

Figure 8A:
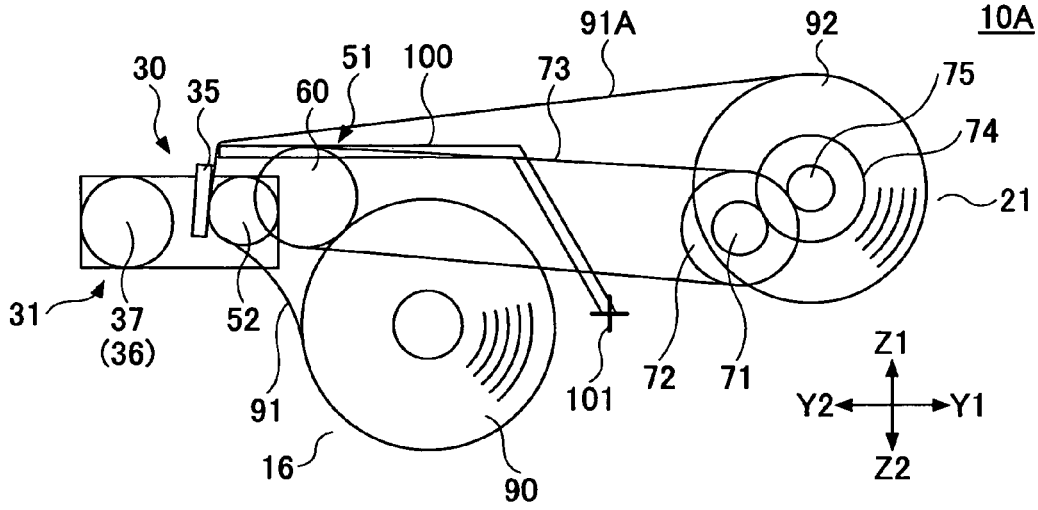
FIGS. 8A and 8B are diagrams showing a basic configuration of a journal thermal printer apparatus according to a second embodiment of the present invention.
Figure 8B:
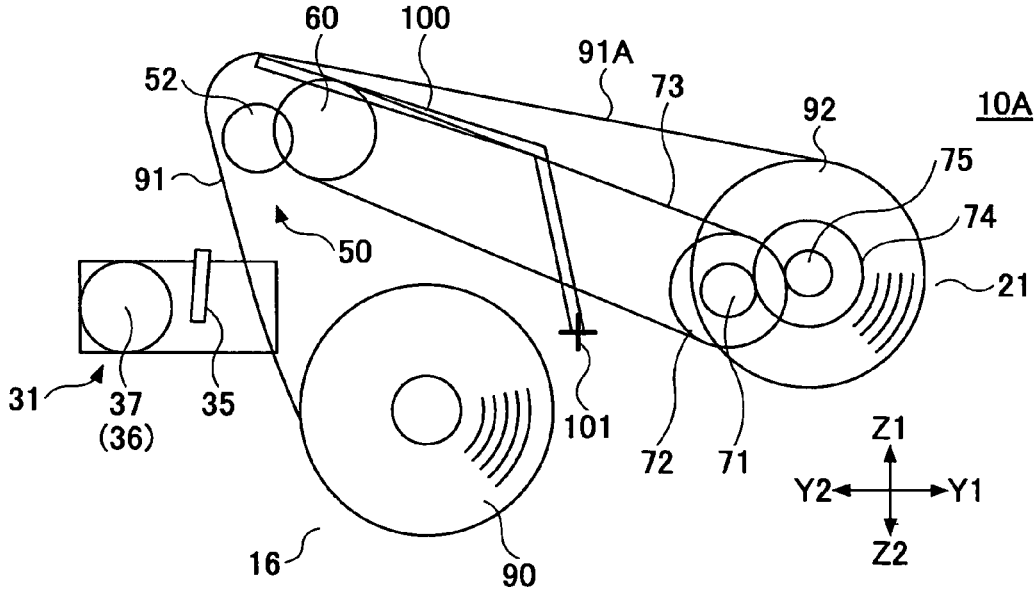
Figure 9:
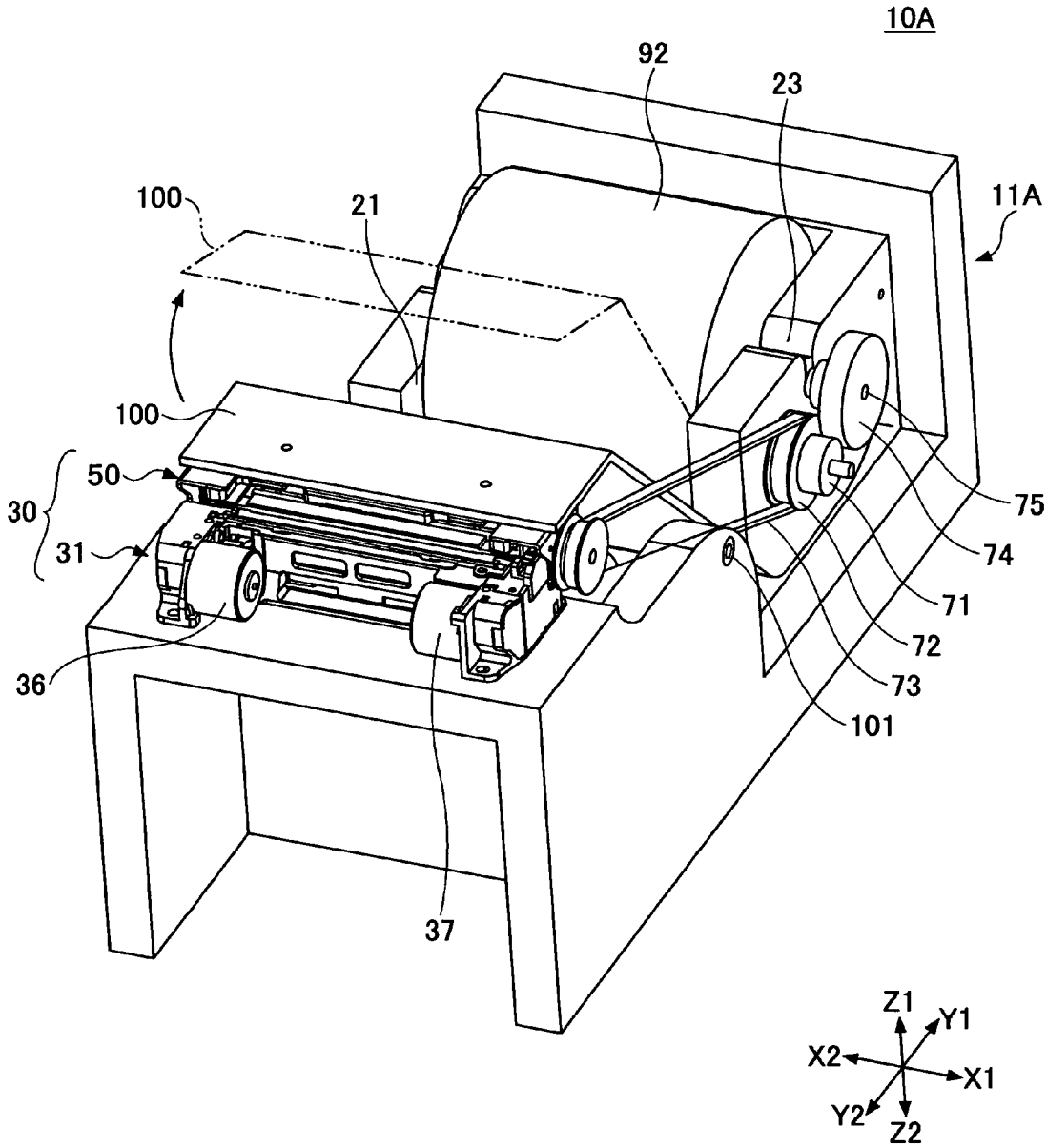
FIG. 9 is a perspective view of the journal thermal printer apparatus of the second embodiment.

FIGS. 8A and 8B are diagrams showing a basic configuration of a journal thermal printer apparatus 10A according to a second embodiment of the present invention. FIG. 9 is a perspective view of the journal thermal printer apparatus 10A.

The journal thermal printer apparatus 10A (simply referred to as 'printer apparatus 10A' hereinafter) has the following differences with respect to the printer apparatus 10 of the first embodiment of FIGS. 1 through 3.

The printer apparatus 10A includes a first chassis 11A, a rotating lid member 100, a journal paper roll accommodating portion 21 arranged at the first chassis 11A, and a heat sensitive paper roll accommodating portion 16 that may be opened/closed by rotating the rotating lid member 100.

The journal paper roll accommodating portion 21 is arranged at a portion of the first chassis 11A. The rotating lid member 100 substantially corresponds to the extending plate portion 22 of the second chassis 20 of the printer apparatus 10 shown in FIG. 3. The rotating lid member 100 is supported by a shaft 101 at the first chassis 11A, and is arranged to rotate between a 'closed position' as is shown in FIGS. 8A and 9, and an 'open position' as is shown in FIG. 8B. It is noted that in FIG. 9, the two-dotted lines indicate the 'open position' of the rotating lid member 100. When arranged at the 'closed position', the rotating lid member 100 covers the upper side of the heat sensitive paper roll accommodating portion 16.

In the printer apparatus 10A of the present embodiment, a first module 31 of a printer unit 30 is attached to the first chassis 11A, and a second module 50 of the printer unit 30 is attached to the lower surface of an edge of the rotating lid member 100.

Also, in the printer apparatus 10A, a printed heat sensitive paper roll 92 is formed at the journal paper roll accommodating portion 21, and a new heat sensitive paper roll 90 may be accommodated within the heat sensitive paper roll accommodating portion 16 by opening the rotating lid member 100.

It is noted that the Y1-Y2 direction dimension of the rotating lid member 100 may be arranged to be smaller than the Y1-Y2 direction dimension of the second chassis 20 of the printer apparatus 10 of the first embodiment, and thereby, the amount of movement in the Z1 direction of the second module 50 upon opening the upper side of the first heat sensitive paper roll accommodating portion 16 may be reduced in the present embodiment so that operability of the printer apparatus 10A may be improved. Also, by reducing the Y1-Y2 direction dimension of the rotating lid member 100, the upper side of the first heat sensitive paper roll accommodating portion 16 may be opened through simple operations. Such an arrangement may be particularly convenient when the new heat sensitive paper roll 90 has a large diameter. When the diameter of the heat sensitive paper roll 90 is large, the printed heat sensitive paper roll 92 may also be large in diameter and heavy. In the present embodiment, the printed heat sensitive paper roll 92 may not exert a load on the rotating lid member 100 when opening the rotating lid member 100, and thereby, the rotating lid member 100 may be easily opened. In turn, the operations for loading a new heat sensitive paper roll 90 may be facilitated.

Embodiment 3

Figure 10A:
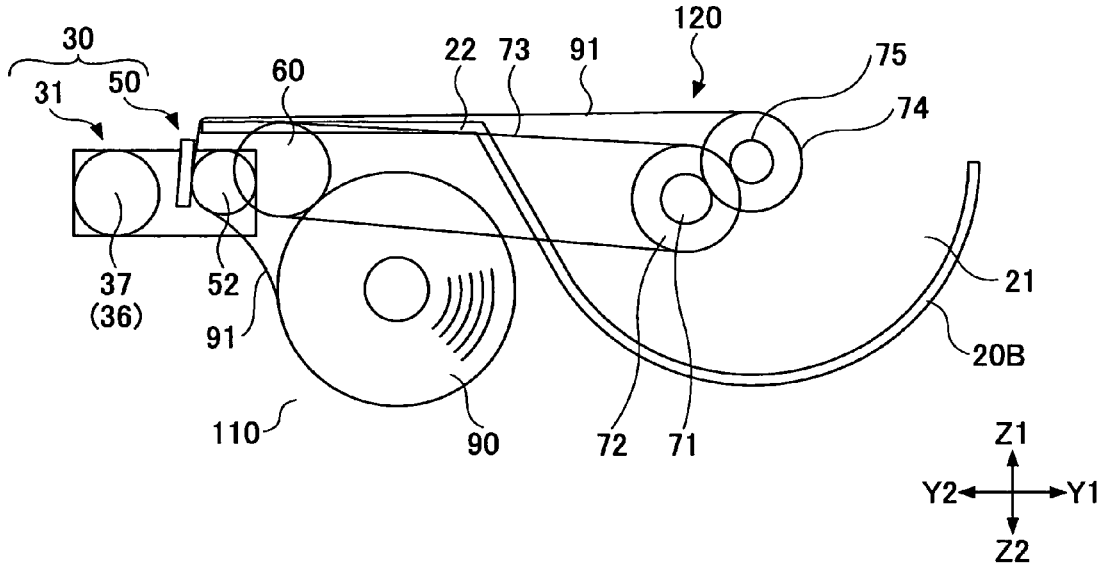
FIGS. 10A and 10B are diagrams showing a basic configuration of a journal thermal printer apparatus according to a third embodiment of the present invention.
Figure 10B:
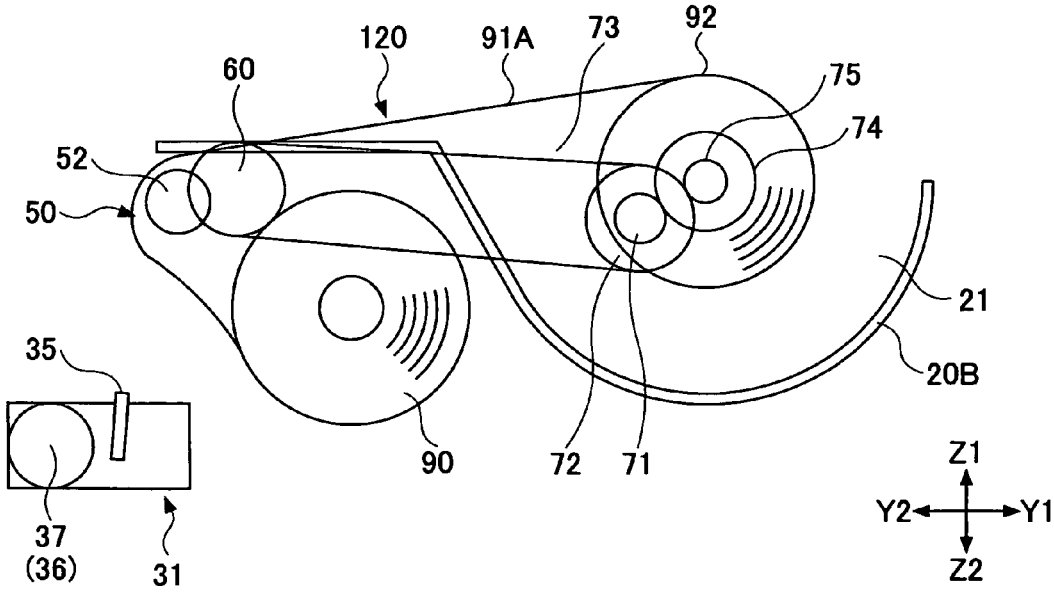
Figure 11:
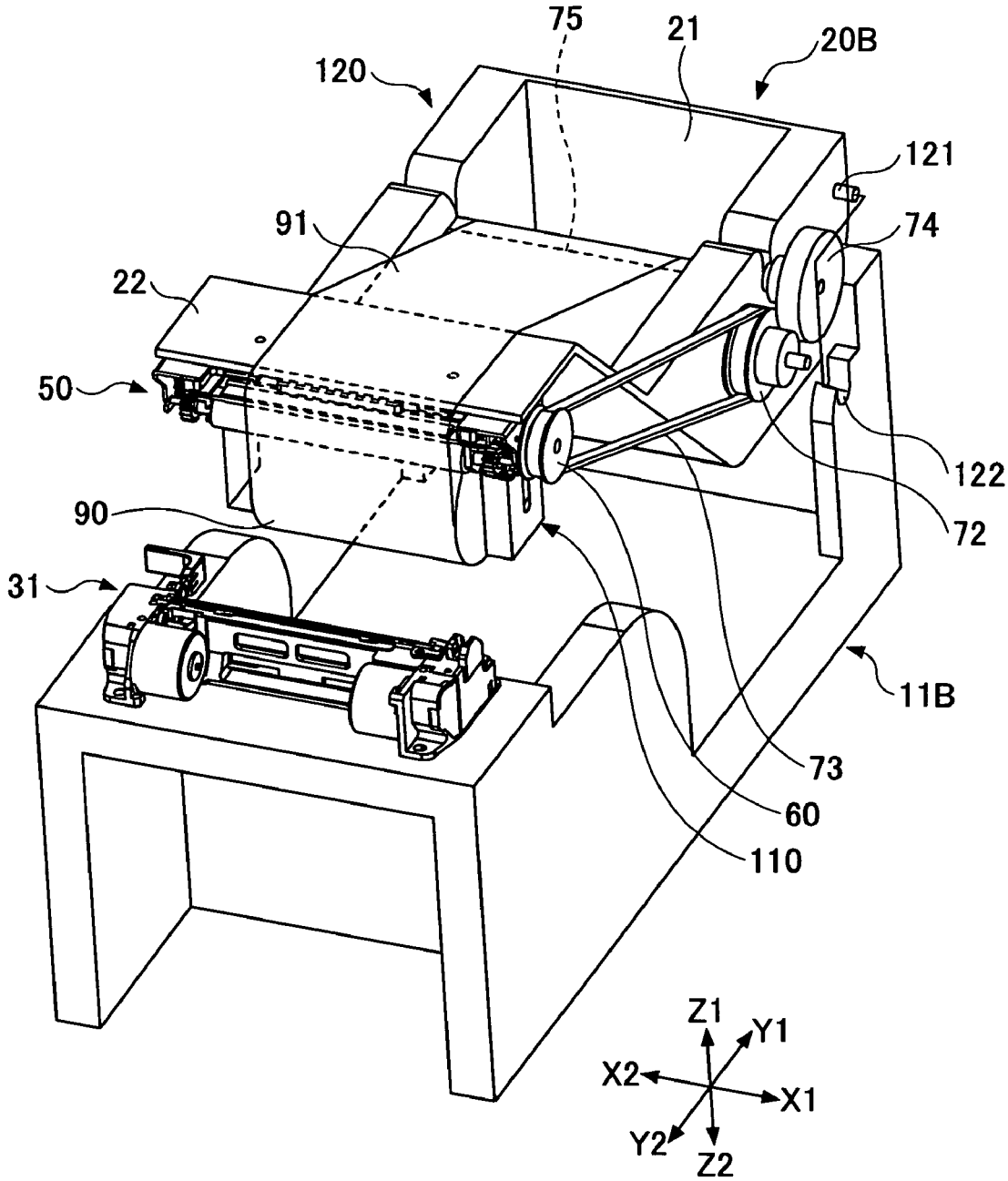
FIG. 11 is an exploded perspective view of the journal thermal printer apparatus of the third embodiment.

FIGS. 10A and 10B are diagrams showing the basic configuration of a journal thermal printer apparatus 10B according to a third embodiment of the present invention. FIG. 11 is a perspective view of the journal thermal printer apparatus 10B.

The journal thermal printer apparatus 10B (simply referred to as 'printer apparatus 10B' hereinafter) has the following differences with respect to the printer apparatus 10 of the first embodiment of FIGS. 1 through 3.

The printer apparatus 10B includes a second chassis 20B that constitutes a cassette 120. The second chassis 20B is configured to be attached to or detached from a first chassis 11B of the printer apparatus 10B.

In the printer apparatus 10B of the present embodiment, a first module 31 of the printer unit 30 is attached to the first chassis 11B, and a second module 50 is attached to the second chassis 20B.

Figure 12:
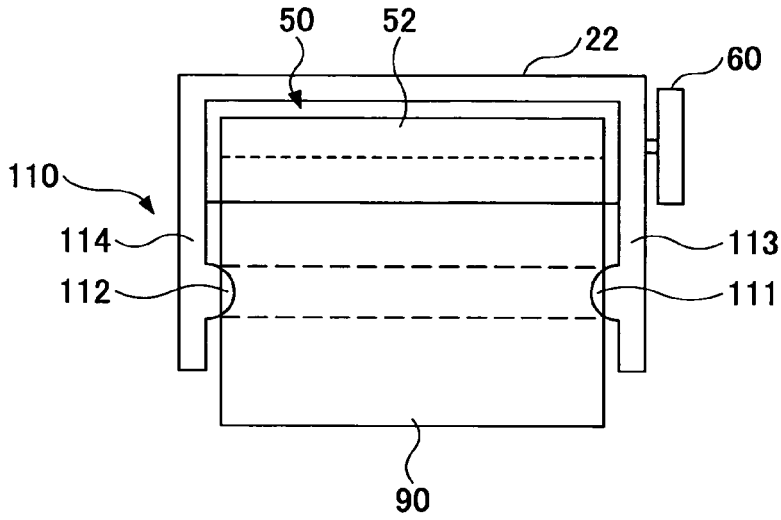
FIG. 12 is a diagram showing a heat sensitive paper roll supporting portion of the journal thermal printer apparatus of the third embodiment.

The second chassis 20B includes a journal paper roll accommodating portion 21, an extending plate portion 22, and a heat sensitive paper roll supporting portion 110 that is arranged at the lower side of the extended plate portion 22. As is shown in FIG. 12, the heat sensitive paper roll supporting portion 110 includes support arms 113 and 114 that have spring characteristics and are arranged at the X1 and X2 sides, respectively. The support arms 113 and 114 have convex portions 111 and 112 arranged close to their respective edges. The heat sensitive paper roll 90 has a center hole, and the side ends of this center hole are arranged to engage with the convex portions 111 and 112 so that the heat sensitive paper roll supporting portion 110 may be supported in a suspended state. Also, the second chassis 20B includes support pins 121 that are arranged at the X1 and X2 sides of the journal paper roll accommodating portion 21.

Before the second chassis 20B is attached to the first chassis 11B, the heat sensitive paper roll 90 is supported by the heat sensitive paper roll supporting portion 110, the heat sensitive paper 91 drawn from the heat sensitive paper roll 90 is arranged to extend across the front side of the second module 50 and the upper side of the extending plate portion 22, and the edge portion of the heat sensitive paper 91 is wound around the journal paper roll shaft 75.

From this state, the operator may lower the second chassis 20B supporting the heat sensitive paper roll 90 from the Z1 side to couple the second chassis 20B to the first chassis 11B. In this case, first, the support pins 121 may be engaged with the U-shaped grooves 122 of the first chassis 11B, and then, the Y2 side of the second chassis 20B may be lowered, for example.

In this way, the second module 50 may be coupled to the first module 31, and the second chassis 20B may be coupled to the first chassis 11B. With respect to the second module 50 and the first module 31, the heat sensitive paper 91 may be held between the platen roller 52 and the thermal head 35 (see FIG. 10A), the gear 54 may be engaged with the output gear 39, and the gear 56 may be engaged with the output gear 41 (see FIG. 7). In this state, a printing operation may be performed, and as the printing operation progresses, the printed heat sensitive paper roll 92 may be formed around the periphery of the journal paper roll shaft 75.

When the heat sensitive paper roll 90 is used up, the operator may remove the cassette 120 from the first chassis 11B as is shown in FIG. 10B, and set a new cassette 120 into the first chassis 11B. In this way, a printing operation may be enabled. As can be appreciated from the above descriptions, heat sensitive paper roll exchange operations may be realized through simple procedures in the present embodiment.

(Exemplary Arrangement of Journal Thermal Printer Apparatus 10/10A/10B)

In the following, an exemplary arrangement of the journal thermal printer apparatus 10/10A/10B is described.

Figure 13:
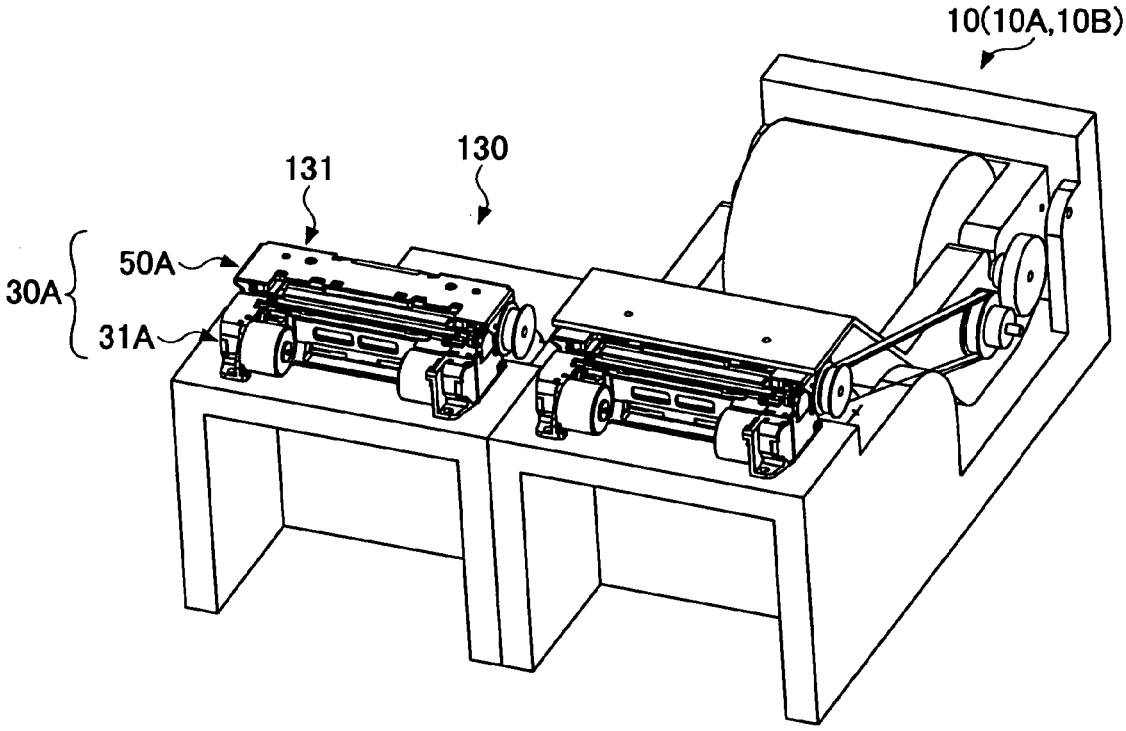
FIG. 13 is a diagram showing an exemplary arrangement of a journal thermal printer apparatus according to an embodiment of the present invention.

As is shown in FIG. 13, the journal thermal printer 10/10A/10B may be arranged next to a receipt printer apparatus 130. The receipt printer apparatus 130 is a clam shell type printer that has a printer unit 30A including a first module 31A and a second module 50A that is detachably coupled to the first module 31A. The printer unit 30A is different from the printer unit 30 of the journal thermal printer apparatus 10/10A/10B in that it includes a cutting mechanism 131.

(Exemplary Modifications of Journal Thermal Printer Apparatus 10/10A/10B)

In the following, exemplary modifications of the journal thermal printer apparatus 10/10A/10B are described.

According to one modified embodiment, the pulley 60 may incorporate a one-way clutch instead of the torque limiter portion 63 shown in FIG. 7.

According to another modified embodiment, the pulley 60 may be arranged into a conventional pulley configuration, and another pulley such as the pulley 72 may incorporate a torque limiter portion.

Figure 14:
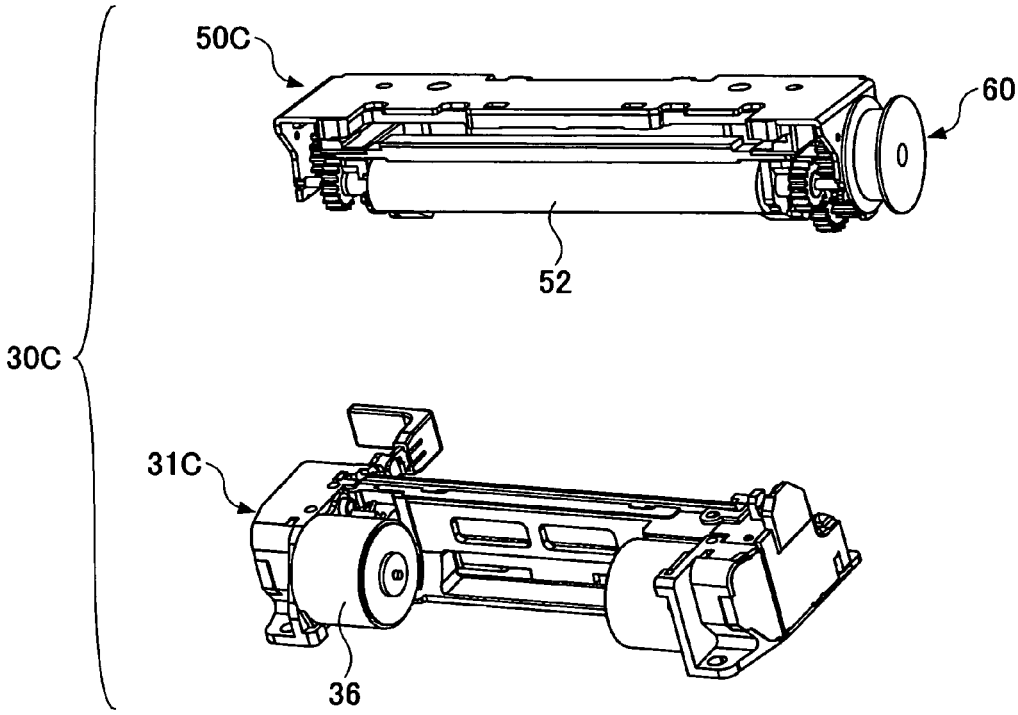
FIG. 14 is a diagram showing a modified printer unit according to an embodiment of the present invention.

FIG. 14 is a diagram illustrating a printer unit 30C according to one modified embodiment.

The printer unit 30C includes a first module 31C and a second module 50C that is coupled to the first module 31C. In the present embodiment, the first module 31C includes a paper transporting pulse motor 36 but does not include the journal paper rolling pulse motor 37, and the paper transporting pulse motor 36 is configured to rotate the platen roller 52 as well as the pulley 60.

Figure 15:
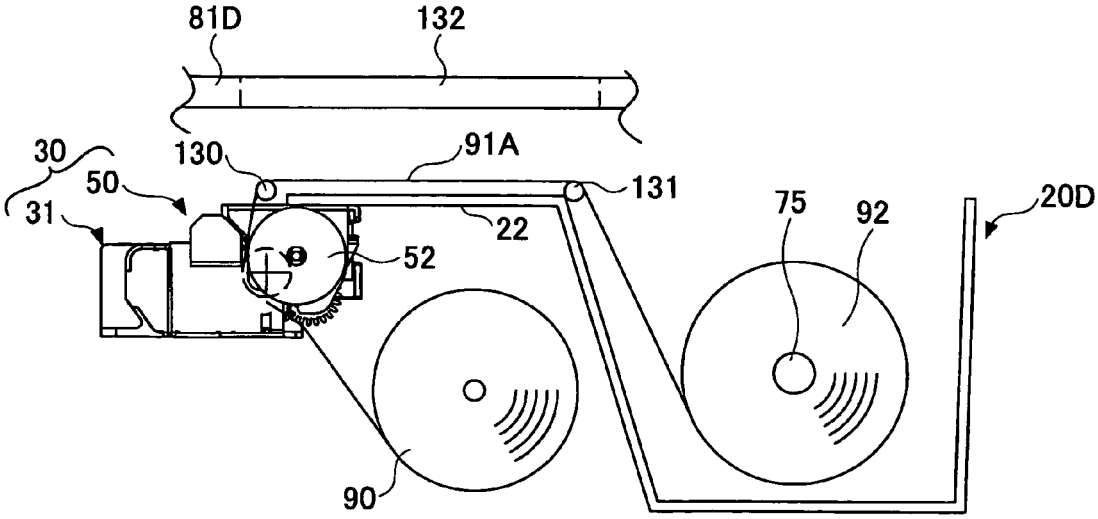
FIG. 15 is a diagram showing a modified configuration of the journal thermal printer apparatus of the first embodiment.

FIG. 15 is a diagram illustrating a modified embodiment of the journal thermal printer apparatus according to the first embodiment. In this modified embodiment, a second chassis 20D includes an extended plate portion 22, cylindrical guide bars 130 and 131 arranged at the Y2 and Y1 sides of the upper side of the extended plate portion 22, respectively, and a journal paper roll shaft 75 that is configured to rotate in the counterclockwise direction. The printer apparatus of the present modified embodiment includes a top lid member 81D having a window 132, and printed heat sensitive paper 91A is arranged to be guided by the guide bars 130 and 131 to move across a path right below the window 132 that extends at substantially the same height position regardless of the diameter of the printed heat sensitive paper roll 92. In this way, printed contents may be viewed from the window 132.

Figure 16:
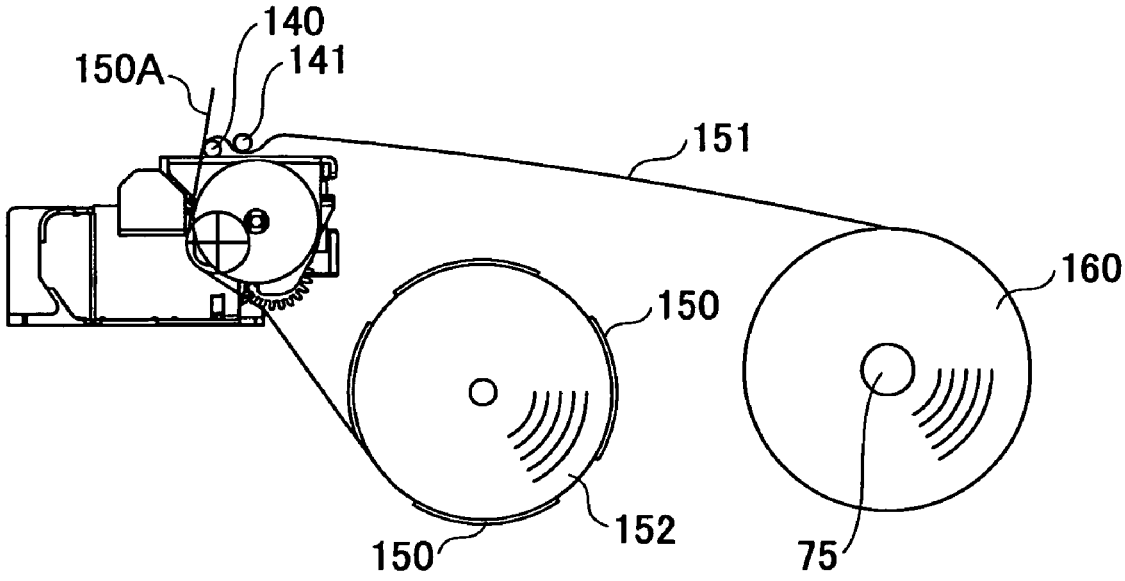
FIG. 16 is a diagram showing another modified journal thermal printer apparatus in which a label sheet roll is used.

FIG. 16 is a diagram illustrating another modified embodiment of the journal thermal printer apparatus. In this embodiment, a label paper roll 152 that has labels 150 attached to tape shaped release paper 151 is used, and a printed label 150A is arranged to be separated from the tape shaped release paper 151 by separating bars 140 and 141 to be output in the Z1 direction while the tape shaped release paper 151 from which the printed label 15A is peeled off is wound around a roll shaft 75 to be arranged into a roll 160.

According to an aspect of one or more of the embodiments described above, by arranging an open/close member to open/close through rotation, a clam shell type journal thermal printer apparatus may be realized. According to another aspect, by arranging a printed paper roll shaft to be rotated by a motor of a printer unit via a rotating body and a rotation transmitting mechanism, the printed paper roll shaft may be provided with adequate force so that printed paper may be securely and stably rolled up.

It is noted that although the present invention is shown and described with respect to certain preferred embodiments, it is obvious that equivalents and modifications will occur to others skilled in the art upon reading and understanding the specification. The present invention includes all such equivalents and modifications, and is limited only by the scope of the claims.

The present application is based on and claims the benefit of the earlier filing date of Japanese Patent Application No. 2005-099873 filed on Mar. 30, 2005, the entire contents of which are hereby incorporated by reference.

What is claimed is:

1. A printer apparatus comprising:

a printer unit including a thermal head, a platen roller, and a motor;

a heat sensitive paper roll accommodating portion that accommodates a heat sensitive paper roll;

a printed paper roll shaft that rolls up printed paper that is drawn from the heat sensitive paper roll and is carried through the printer unit;

a rotating open/close member that is arranged to be opened/closed through rotation; and a rotation transmitting mechanism that transmits a rotation of the motor of the printer unit to the printed paper roll shaft, wherein:

the motor includes a first motor and a second motor, the first motor being configured to rotate the platen roller, and the second motor being configured to rotate the printed paper roll shaft, and when the rotating open/close member is closed, the rotating open/close member covers the heat sensitive paper roll accommodating portion, the platen roller comes into contact with the thermal head and is rotated by the first motor, and the printed paper roll shaft is rotated by the second motor via the rotation transmitting mechanism.

2. A printer apparatus comprising:

a printer unit that includes a thermal head, a first module including a motor, and a second module including a platen roller and a rotating body;

a printed paper roll shaft that rolls up printed paper that is drawn from a heat sensitive paper roll and is carried through the printer unit;

a first chassis that includes a heat sensitive paper roll accommodating portion that accommodates the heat sensitive paper roll, and a first mount portion to which the first module is mounted;

a second chassis that is configured to rotate with respect to the first chassis to be opened/closed, the second chassis including a second mount portion to which the second module is mounted, a rotation transmitting mechanism that transmits a rotation of the rotating body to the printed paper roll shaft, and a printed paper roll accommodating portion that accommodates a printed paper roll that is created by rolling the printed paper around the printed paper roll shaft, wherein:

the motor includes a first motor and a second motor, the first motor being configured to rotate the platen roller, and the second motor being configured to rotate the printed paper roll shaft, and when the second chassis is closed, the heat sensitive paper roll accommodating portion is closed, the second module is coupled to the first module, the platen roller is rotated by the first motor, the rotating body is rotated by the first motor, and the printed paper roll shaft is rotated by the second motor via the rotating body and the rotation transmitting mechanism.

3. The printer apparatus as claimed in claim 2, wherein when the second chassis is opened, the heat sensitive paper roll accommodating portion is opened, and the second module is detached from the first module.

4. A printer apparatus comprising:

a printer unit that includes a thermal head, a first module including a motor, and a second module including a platen roller and a rotating body;

a chassis including a heat sensitive paper roll accommodating portion that accommodates a heat sensitive paper roll, a printed paper roll shaft that rolls up printed paper that is drawn from the heat sensitive paper roll and is carried through the printer unit, a printed paper roll accommodating portion that accommodates a printed paper roll that is created by rolling the printed paper around the printed paper roll shaft, and a first mount portion to which the first module is mounted;

a rotating lid member that is configured to rotate with respect to the chassis to be opened/closed, the rotating lid member including a second mount portion to which the second module is mounted; and a rotation transmitting mechanism that transmits a rotation of the rotating body to the printed paper roll shaft, wherein;

the motor includes a first motor and a second motor the first motor being configured to rotate the platen roller, and the second motor being configured to rotate the printed paper roll shaft, and when the rotating lid member is closed, the heat sensitive paper roll accommodating portion is closed, the second module is coupled to the first module, the platen roller is rotated by the first motor, the rotating body is rotated by the frist motor, and the printed paper roll shaft is rotated by the second motor via the rotating body and the rotation transmitting mechanism.

5. The printer apparatus as claimed in claim 4, wherein when the rotating lid member is opened, the heat sensitive paper roll accommodating portion is opened, and the second module is detached from the first module.

6. A printer apparatus comprising:

a printer unit that includes a thermal head, a first module including a motor, and a second module including a platen roller and a rotating body;

a printed paper roll shaft that rolls up printed paper that is drawn from a heat sensitive paper roll and is carried through the printer unit;

a first chassis that includes a heat sensitive paper roll accommodating portion that accommodates the heat sensitive paper roll, and a first mount portion to which the first module is mounted;

a second chassis that is configured to be attached to and detached from the first chassis, the second chassis including a second mount portion to which the second module is mounted, a shaft mount portion to which the printed paper shaft is mounted, a rotation transmitting mechanism that transmits a rotation of the rotating body to the printed paper roll shaft, a heat sensitive paper roll supporting portion that is arranged at a lower surface side of the second chassis and is configured to support the heat sensitive paper roll, and a printed paper roll accommodating portion that is arranged at an upper surface side of the second chassis and is configured to accommodate a printed paper roll that is created by rolling the printed paper around the printed paper roll shaft;

wherein heat sensitive paper that is drawn from the heat sensitive paper roll is arranged to pass a portion of the second module and the upper surface side of the second chassis, and an edge portion of the heat sensitive paper is arranged to be wound around the printed paper roll shaft; and when the second chassis is attached to the first chassis, the second module is coupled to the first module, the platen roller is rotated by the motor, the rotating body is rotated by the motor, and the printed paper roll shaft is rotated by the motor via the rotating body and the rotation transmitting mechanism.

7. The printer apparatus as claimed in claim 6, wherein the motor includes a first motor and a second motor, the first motor being configured to rotate the platen roller and the second motor being configured to rotate the printed paper roll shaft.

8. A printer apparatus comprising:

a printer unit that performs printing on a label that is attached to tape shaped release paper of a label paper roll;

a chassis that is configured to be opened/closed through rotation;

a printed label separating unit that is configured to separate a printed label from the tape shaped release paper; and a tape shaped release paper roll shaft configured to roll up the tape shaped release paper from which the printed label is separated;

wherein a rotation of a motor of the printer unit is transmitted to the tape shaped release paper roll shaft, and tape shaped release paper roll shaft is rotated by the rotation of the motor.

* * * * *

UNITED STATES PATENT AND TRADEMARK OFFICE

CERTIFICATE OF CORRECTION

PATENT NO. : 7,362,346 B2
APPLICATION NO. : 11/299627
DATED : April 22, 2008
INVENTOR(S) : Sumio Watanabe et al.

It is certified that error appears in the above-identified patent and that said Letters Patent is hereby corrected as shown below:

Column 12, Line 27, change “wherein;” to --wherein:--.

Column 12, Line 28, change “second motor” to --second motor,--.

Column 12, Line 36, change “frist” to --first--.

Signed and Sealed this

Second Day of September, 2008

JON W. DUDAS
*Director of the United States Patent and Trademark Office*